United States Patent [19]

Shiurila

[11] 4,381,896

[45] May 3, 1983

[54] PRINT HEAD MOUNTING ASSEMBLY WITH FORM ADJUSTMENT

[75] Inventor: John Shiurila, Londonderry, N.H.

[73] Assignee: Centronics Data Computer Corporation, Hudson, N.H.

[21] Appl. No.: 199,017

[22] Filed: Oct. 20, 1980

[51] Int. Cl.[3] ..... B41J 11/20

[52] U.S. Cl. ..... 400/56; 400/59; 400/124; 400/320

[58] Field of Search ..... 400/124, 692, 56, 57, 400/59, 175, 357, 352, 353, 320, 161.5

[56] References Cited

U.S. PATENT DOCUMENTS

| | | | |
|---|---|---|---|
| 3,696,906 | 10/1972 | Salto et al. | 400/161.5 |
| 3,776,341 | 12/1973 | Dobner et al. | 197/127 R |
| 3,799,311 | 3/1974 | Guerrini et al. | 400/175 X |
| 3,921,780 | 11/1975 | Gentzlinger et al. | 400/124 X |
| 3,935,936 | 2/1976 | Wilczewski | 197/1 R |
| 3,960,256 | 6/1976 | Bickoff et al. | 197/1 R |
| 4,023,662 | 5/1977 | Perucca | 197/1 R |
| 4,086,997 | 5/1978 | Wu | 400/57 |
| 4,256,408 | 3/1981 | Shelton | 400/124 |

FOREIGN PATENT DOCUMENTS 2838627 3/1979 Fed. Rep. of Germany .

*Primary Examiner*—Edgar S. Burr
*Assistant Examiner*—Moshe I. Cohen
*Attorney, Agent, or Firm*—Kenway & Jenney

[57] ABSTRACT

An assembly for mounting a print head upon a carriage having an adjustable collar and a slotted support which receive opposing ends of an elongated shaft secured to the print head. The shaft is accurately positioned on the carriage by means of openings in said collar and said support which receive cooperating portions of said shaft. A spring biased cylindrical member retains the shaft within the carriage support and the collar. The collar is provided with a pair of projections which are engaged by the cam surface of a cam member rotatably mounted upon the shaft for adjusting the axial position of the print head relative to said collar and hence relative to a web supporting platen. The forms thickness setting assembly is accurately adjusted simply by axial adjustment of the collar, to assure the accuracy of all forms thickness settings through only a single adjustment step. A second pin secured to the print head is received within the slot of a second support on the carriage to assure precise angular orientation of the print head. The carriage is designed for use in a wide varieties of printers.

8 Claims, 12 Drawing Figures

PRINT HEAD MOUNTING ASSEMBLY WITH FORM ADJUSTMENT

FIELD OF THE INVENTION

The present invention is related to print head mounting assemblies for use in impact printers and the like and more particularly to a novel mounting assembly to facilitate simple, rapid mounting and dismounting of a print head upon a print head carriage without the need for any conventional fastening means and incorporating a forms thickness adjustment assembly which is designed to simply and accurately adjust all forms thickness settings through the use of only a single adjustment operation.

BACKGROUND OF THE INVENTION

Impact printers of the dot matrix type are typically comprised of a print head supported upon a reciprocating carriage which moves across a stationary platen supporting a print receiving medium to effect printing. A print head is typically comprised of a housing for reciprocally mounting a plurality of print wires. The forward tips of the print wires extend through a jewel bearing at the nose of the print head while the rearward ends are driven by electromagnets to rapidly accelerate the print wires so as to achieve a velocity sufficient to impact an inked ribbon and transfer the ink therefrom to the print receiving medium. Although print heads of the type described are formed of highly reliable precision machined and/or precision molded parts, print heads nevertheless have a limited useful operating life, typically of the order of 15–20 million characters, and require periodic replacement. In addition, it is also desirable to be able to remove print heads for maintenance and inspection purposes and to gain access to surrounding components and structures, as well as the print heads themselves. In addition, it is highly desirable to increase the versatility of printers by the substitution of one type of print head for another. For example, print heads, although having the same basic overall design, may be provided with five, seven or nine print wires, for example, in order to print characters of lesser or greater resolution. The simplest way of obtaining these changes of character resolution is by direct substitution of a nine-wire print head for a seven-wire print head, for example. In the past, it has been conventional to mount print heads directly upon the carriage assembly by conventional fastening means such as threaded fasteners which pass through openings provided in the print head and threadedly engage tapped openings provided in the carriage. This arrangement is slow and tedious and further requires that the operator has sufficient skill to assemble and disassemble the aforesaid printer components.

In order to simplify the mounting and removal of print heads upon their carriage assemblies, a mounting bracket assembly has been developed and is described in detail in copending application Ser. No. 974067 filed Dec. 28, 1978, now U.S. Pat. No. 4,286,888 and assigned to the assignee of the present invention. The mounting bracket of the aforesaid pending application is secured to the print head by conventional fastening means and is provided with a pair of spring-loaded pins having enlarged heads which cooperate with a pair of slots provided in the carriage assembly for slidably mounting the print head upon the carriage assembly. A handle assembly which is capable of being swung between a locked and an unlocked position, and which is mounted upon the carriage, is initially maintained in the unlocked position to slide the print head and its cooperating mounted bracket on to the carriage assembly. The handle assembly is then swung to the locked position to secure the print head on the carriage. The handle assembly is formed of a resilient metallic member which exerts a biasing force upon the print head to normally urge the print head toward the platen. Rotatable cam means are provided along the forward end of the carriage to limit movement of the print head in the direction of the platen to provide a forms thickness adjustment.

The mounting assembly described in the aforementioned copending patent application is both bulky and heavy and requires that sufficient clearance be provided in the printer to slidably mount the print head upon the carriage assembly. In addition, it is not possible to provide precise forms thickness settings which may be repeatedly obtained without the need for additional adjustment each time a forms thickness setting is changed, thereby adding to the complexity of the forms thickness adjustment. Also, the mounting assembly requires a separate handle assembly mounted upon the carriage.

BRIEF DESCRIPTION OF THE INVENTION

The present invention is characterized by comprising a mounting assembly for facilitating the rapid and yet accurate dismounting and mounting of a print head upon a carriage and incorporating a simplified and yet highly accurate forms thickness adjustment assembly which is simply and rapidly movable to any one of its forms thickness settings, all of which settings are automatically accurate and precise after making only a single forms thickness adjustment at one of said forms thickness settings, thereby assuring the accuracy of all of the forms thickness settings. In addition, the mounting assembly totally eliminates the need for a separate handle assembly, and permits the print head to be dropped into position from a location directly above the position occupied by the print head upon the carriage, thereby significantly reducing the clearance area for mounting the print head upon the carriage.

The aforesaid novel mounting assembly of the present invention comprises a carriage having an axially adjustable collar member and a support which is an integral part of said carriage. The mounting assembly portion secured to the print head is comprised of an elongated shaft rotatably supporting a cam member, positioned intermediate its forward and rearward ends. The forward end of the shaft is adapted to be positioned within a central opening provided in said adjustable collar, while the rearward end of the shaft, which is provided with an enlarged diameter portion, is adapted to be seated within an enlarged opening arranged at the base of the elongated slot provided on the carriage. To mount the print head, the print head is positioned with the forward end of the shaft generally above the collar and the rearward end of the shaft above the portion of the carriage. The print head is pushed downwardly so that the smaller diameter portion of the shaft slides within the slot provided on the carriage. A spring-loaded collar axially slidable along said shaft cooperates with an inclined surface along the slotted portion of the carriage to exert a biasing force upon the slotted portion which normally urges the shaft toward the direction of the collar. As the shaft reaches the base of the elongated slot, its enlarged diameter portion snaps into place within the enlarged opening in the slotted portion of the carriage due to the spring loaded collar, to automatically and positively seat the enlarged portion of the shaft within the slotted portion of the carriage. As the shaft snaps forward under the force of the spring-biased collar, the forward free end of the shaft snaps into the receiving clearance opening provided in the adjustable collar. A stub shaft is mounted upon the print head and cooperates with a second slot in the carriage to positively and accurately align the print head relative to the platen and prevent the print head from rotating. The enlarged portion of the cam supporting shaft snaps into position in the left-hand slot on the carriage. The spring loaded collar is normally biased to engage the near end of the enlarged diameter portion of the shaft. A portion of the upper end of the carriage is tapered to facilitate mounting of the print head and help to move the collar forward and permit the enlarged diameter portion of the shaft to drop into the enlarged opening provided in the carriage.

The rotatably mounted cam cooperates with a pair of wing-like projections provided on the aforementioned adjustable collar and is movable to any one of a plurality of settings to provide forms thickness adjustments. The surface of the rotatable cam which is engaged by said wing-like projections is provided with pairs of diametrically opposed radially aligned grooves of equal depth, each pair of grooves having a different depth relative to every other pair of grooves, to adjust the axial position of the shaft and hence the print head relative to the cooperating projections on the collar, thereby positively locating the nose of the print head a spaced distance from the platen which supports the print receiving medium. The collar is axially slidable within a bore provided in an upright portion of the carriage and after appropriate axial positioning, is locked into place by a lockwasher and screw provided in the upright portion of the support containing said bore which portion is an integral portion of the carriage. The screw threadedly engages the adjustable collar through an adjustment slot provided in the collar support on the carriage.

The spring loaded collar is also provided with a thumbscrew as an added feature, to lock the collar against movement during extreme printing speeds to prevent the print head from moving backwards and away from the platen.

Initial adjustment of the forms thickness assembly is accomplished by setting the cam member preferably to the first forms thickness setting; placing a shim between the nose of the print head and the platen, the gauge of the shim being equal to the thickness of the form plus normal operating clearance presented by the first forms thickness setting; loosening the screw and moving the print head forward until its nose engages the shim; and thereafter tightening the screw to secure the adjustable collar in the adjusted position. All other forms thickness settings automatically provide the precise gap distance between the nose of the print head and the platen without any further adjustment operations. The forms thickness adjustment is made simply by rotating the cam member, which "snaps" into each forms thickness setting under control of the spring loaded collar to provide a forms thickness indication to the operator that the cam is now locked into the desired setting. Thus, the spring member of the spring loaded collar provides the dual functions of maintaining the print head mounted upon the carriage and maintaining the chosen forms thickness setting of the cam member.

Removal of the print head and its mounting assembly from the carriage is accomplished simply by moving the print head in a rearward direction to lift the enlarged diameter portion of the mounting assembly shaft out of the cooperating large diameter opening in the carriage bracket and thereafter lifting the print head upwardly so that its shaft slides upwardly and out of the first slotted bracket on the carriage.

The print head and carriage assembly design enables its use in a wide variety of printers, as well as other apparatus requiring such adjustment.

OBJECTS OF THE INVENTION AND BRIEF DESCRIPTION OF THE FIGURES

It is therefore one object of the present invention to provide a novel assembly of simplified design for facilitating the rapid and accurate mounting and dismounting of a print head upon a carriage.

Still another object of the present invention is to provide a novel mounting assembly for use with print heads and the like and which incorporates a forms thickness adjustment assembly of simplified design and yet which assures accurate forms thickness adjustments.

Still another object of the present invention is to provide a novel forms thickness assembly for use with print heads and the like and which incorporates an axially adjustable member mounted upon the carriage supporting the print head for simply and accurately adjusting the print head for all forms thickness settings with only a single adjustment.

Still another object of the present invention is to provide a novel mounting assembly for print heads and the like and which is adapted to automatically snap the print head into alignment upon a print head carriage to facilitate mounting thereof and which utilizes resilient biasing means capable of exerting a biasing force sufficient to retain the print head in the operative position on the carriage and yet is sufficiently yieldable to facilitate simple, rapid dismounting of the print head from the carriage.

Still another object of the present invention is to provide a novel assembly for both mounting and accurately aligning print heads on a print head carriage.

Still another object of the present invention is to provide a novel mounting assembly for mounting and accurately aligning print heads on a print head carriage and which is provided with a mounting assembly which includes single spring means for retaining the print head in the mounted position upon the carriage and which retains the aligning adjustment.

The above as well as other objects of the present invention will become apparent when reading the accompanying description and drawing in which:

FIG. 1*a* is a top plan view of a print head, mounting assembly and print head carriage, embodying the principles of the present invention.

FIG. 1*b* shows a left-hand side elevational view of the assembly of FIG. 1*a*.

FIG. 1*c* shows a front elevational view of the assembly of FIG. 1*a*.

FIG. 1*d* shows a rear elevational view of the rear sliding support bearing for the carriage assembly of FIG. 1*a*.

FIG. 1*e* shows a detailed elevational view of the spring loaded collar of FIGS. 1*a* and 1*b* showing the locking thumb screw associated therewith.

FIG. 2 shows a plan view of the shaft which rotatably supports the forms thickness cam member of FIG. 1*a*.

FIGS. 3*a*, 3*b* and 3*c* show left-hand side, top and rear elevational views of the adjustable collar member of FIG. 1*a*.

FIGS. 4*a*, 4*b* and 4*c* show side, side and top plan views respectively of the rotatable cam member provided in the assembly of FIG. 1*a*.

DETAILED DESCRIPTION OF THE FIGURES AND BEST MODE FOR CARRYING OUT THE INVENTION

Figure 1A:
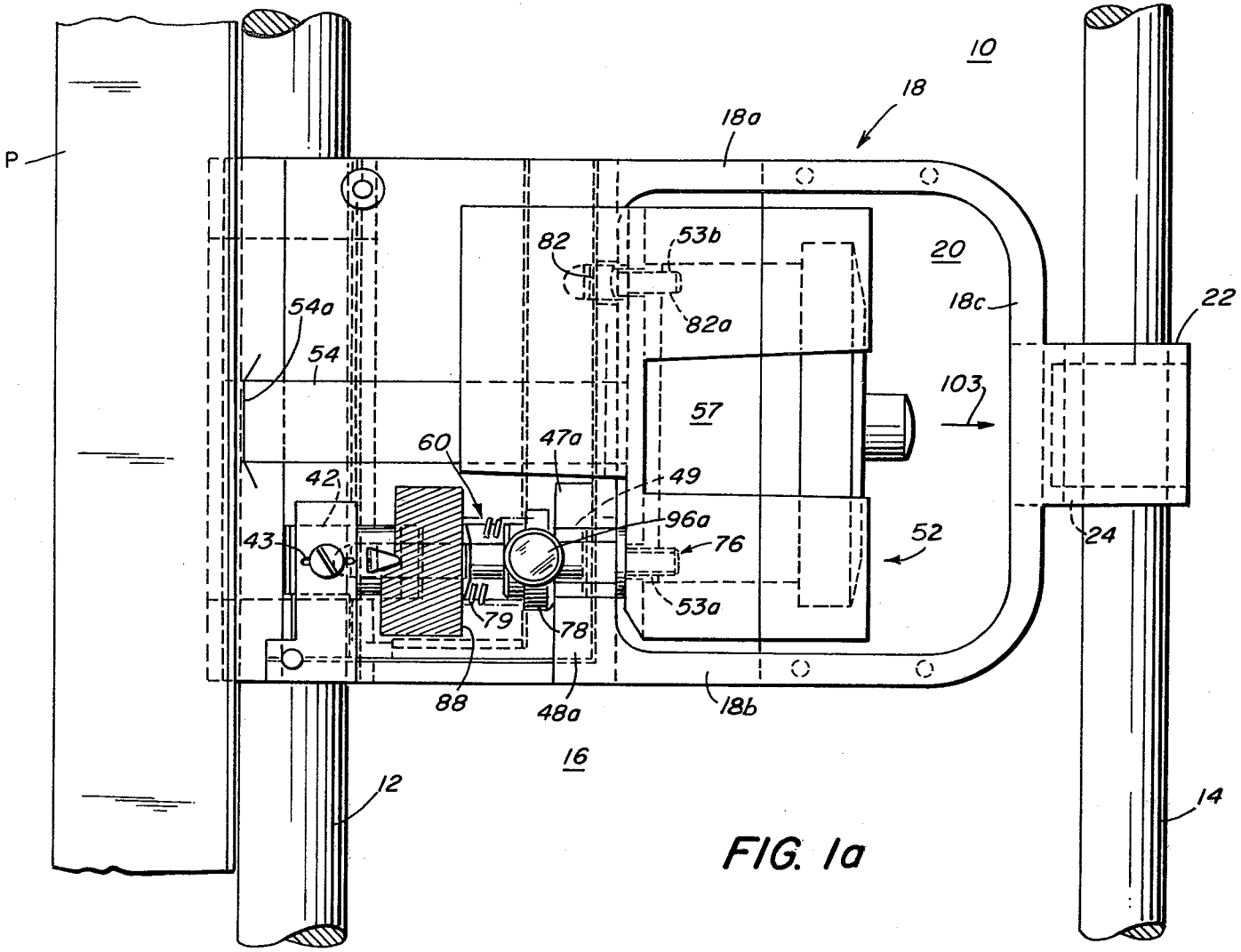

FIGS. 1*a* through 1*e* show an assembly 10 for use in impact printers of the dot matrix type. Such printers are typically comprised of a supporting frame or chassis not shown for purposes of simplicity, and adapted to position and support a pair of spaced parallel guide shafts 12 and 14 which are typically elongated, cylindrical rods. Shafts 12 and 14 slidably support a reciprocally mounted carriage assembly 16 comprised of a rearward portion 18 having an opening 20 for receiving the electromagnet assembly portion of a print head assembly 52. The rearward portion 18 is defined by a pair of rearwardly extending sides 18*a* and 18*b* and a bridging rear side 18*c* integrally joined to sides 18*a* and 18*b* to define three sides of the opening 20. Side 18*c* has integrally joined thereto a substantially U-shaped bearing 22 having a open ended slot 22*a* for receiving and supporting a sleeve 24 formed of a plastic material exhibiting a low coefficient of sliding friction. Sleeve 24 receives shaft 14 through its central opening and slides along shaft 14 as the carriage assembly is reciprocated during printing. Although not shown for purposes of simplicity, it should be understood that the carriage assembly 16 is moved from the left-hand side of the printer to the right-hand side, and from the right-hand side of the printer to the left-hand side by a suitable driving mechanism such as a D.C. motor which may drive the carriage assembly either directly or through all the assemblies and the like. Although a variety of different carriage driving means may be employed, suitable carriage driving means is described, for example, in copending application Ser. No. 947,067 filed Dec. 28, 1978, and assigned to the assignee of the present invention.

The forward end of the carriage assembly is comprised of a pair of downwardly depending portions 26 and 28 each having a circular opening 26*a*, 28*a*, for receiving a plastic sleeve 32, 34 formed of a material having a low coefficient of sliding friction and being adapted to slide along the shaft 12 during reciprocating movement of the carriage 16. The forward portion of the carriage assembly 16 is further comprised of a bridging section 36 which spans between projections 26 and 28 and which extends rearwardly to form a carriage base portion 38.

Extending upwardly from the right-hand side of base portion 38 is a substantially U-shaped section 40 whose forward arm 40*a* is provided with a bore 42 for slidably supporting a collar member 62 which cooperates with the mounting assembly 60 secured to print head assembly 50 for the purpose of releasably mounting print head 50 upon carriage assembly 16 and further providing a means for simply and rapidly adjusting the forms thickness setting of assembly provided on the mounting assembly 60, as will be described in greater detail hereinbelow.

Figure 3A:
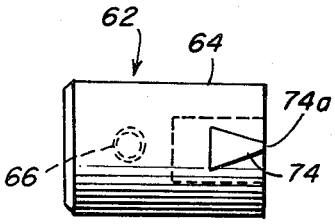
Figure 3B:
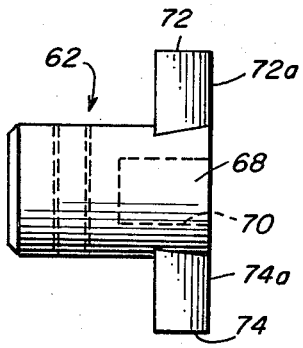
Figure 3C:
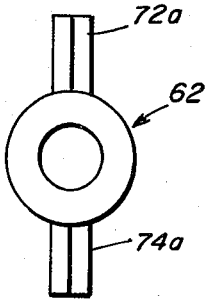

Collar 62, as can best be seen in FIGS. 3*a* through 3*c* is comprised of a substantially cylindrical shaped body 64 having a tapped opening 66 lined transverse to its longitudinal axis 68 and lying along a diameter of the cylinder. The rearward end of collar 64 is provided with an axially aligned opening 70 extending from the rear surface thereof inwardly toward the front surface. A pair of wing-like projections 72 and 74 are arranged on opposite sides of the collar 64 and extend along a common diameter of collar 64. The wing-like projections 72 and 74 have a triangular cross-sectional configuration as shown best by wing-like member 74, FIG. 3*a*. The apex 74*a* of the triangular shape extends towards the rear of collar 62, i.e. toward the same surface containing opening 70. Projection 72 has a similar triangular shape and an apex 72*a*, as shown best in FIGS. 3*b* and 3*c*. Collar 62 is slidably mounted within bore 42 and threadedly engages the threaded portion (not shown) of a threaded fastening member 44 which threaded portion extends through an elongated slot 43 arranged transverse to bore 42 and communicating with bore 42 to enable the lower end (not shown) of threaded 44 to extend to bore 44 and hence into the tapped opening 66 in collar 62. Threaded fastener 44 functions as a screw, so that when loosened it enables collar 62 to be moved along the longitudinal axis of bore 42. When collar 62 is properly adjusted, in a manner to be more fully described hereinbelow, screw 44 is tightened to secure collar 62 within bore 42 in the desired axial position by gripping the upper edge of bore 42.

Rearward arm 40*b* of U-shaped section 40 is provided with a pair of upwardly extending bifurcated arms 47 and 48 which define an elongated slot 50 therebetween for slidably receiving the shaft 76 (note also FIG. 2) of the print head mounting assembly 60. Bifurcated arms 47 and 48 are provided with sloping entry surfaces 47*a* and 48*a*, surface 48*a* being shown best in FIG. 1*b* to form tapered upper ends for arms 47 and 48. Surfaces 47*a* and 48*a* cooperate with a thrust collar 78 slidably mounted upon shaft 76 to facilitate both mounting and removal of the mounting assembly and the print head upon the carriage assembly and to maintain the setting of the cam 88, as will be more fully described. The rear surfaces of bifurcated arms 47 and 48 are machined or otherwise formed to provide a circular shaped bore 49 arranged at the base of elongated slot 50. The diameter of bore 49 is just slightly greater than the enlarged diameter portion 76*a* of mounting shaft 76 and which is designed to cooperate with the bifurcated arms 47 and 48 and enlarged bore 49 in a manner to be more fully described hereinbelow, in order to provide an automatic snap-in fitting arrangement as between mounting assembly 60 and the cooperating bifurcated arms 47 and 48 of the carriage assembly 16.

Figure 2:
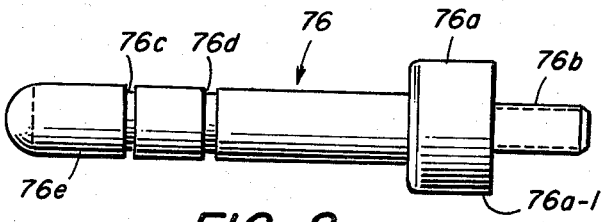

The shaft 76 of print head mounting assembly 60 is shown best in FIGS. 1*a* and 2 and has a rearward threaded portion 76*b* which is adapted to threadedly engage a tapped opening 53*a* provided within a mounting plate 53 forming part of the print head assembly 52. Print head assembly 52 is described in detail in U.S. Pat. No. 4,165,940 issued Aug. 28, 1979 and assigned to the assignee of the present invention. For the purpose of understanding the present invention, it is sufficient to understand that the print head assembly 52 is comprised of a nose cone portion 54 for supporting a plurality of reciprocally mounted print wires 55, whose forward printing tips are arranged to extend through openings 56*a* in a jewel bearing 56 provided at the forward end or nose of nose cone 54, said print wires 55 being adapted to rapidly move toward a platen P by means of associated electromagnets (not shown) arranged within an electromagnet assembly mounting portion 57 forming the rearward part of print head assembly 52. The electromagnet assembly mounting portion 57 of print head 52 is comprised of a common support plate 53 having tapped openings 53*a* and 53*b* for receiving the threaded portion 76*b* of shaft 76 and the threaded portion 82*a* of a stub shaft 82, which cooperates with shaft 76 to assure accurate angular orientation of the print head 52 and hence the print wires 55 relative to platen P.

The enlarged diameter portion 76*a* of shaft 76 has a rounded edge 76*a*-1 to facilitate its insertion into enlarged bore 49 as will be more fully described. Shaft 76 is further provided with a pair of annular grooves 76*c* and 76*d* for receiving and supporting circular clip 84 and Bellville washer 86 respectively, as shown best in FIG. 1*b*.

Figure 1B:
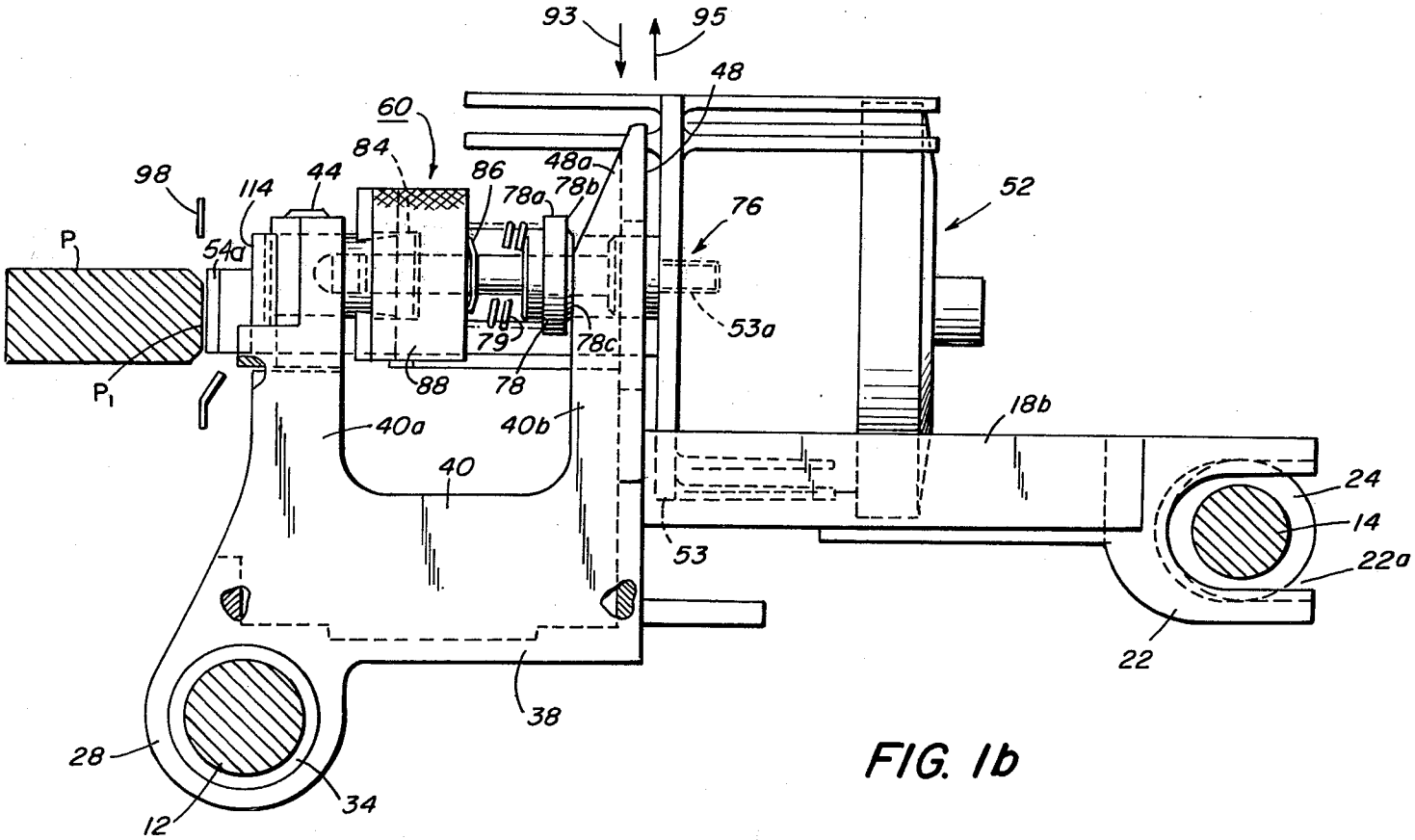
Figure 1D:
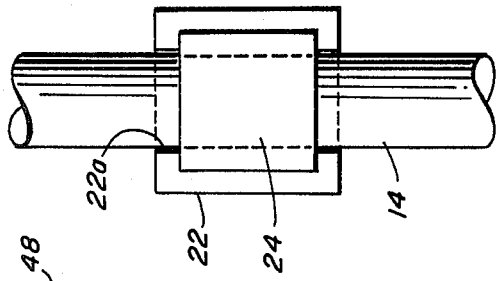
Figure 1E:
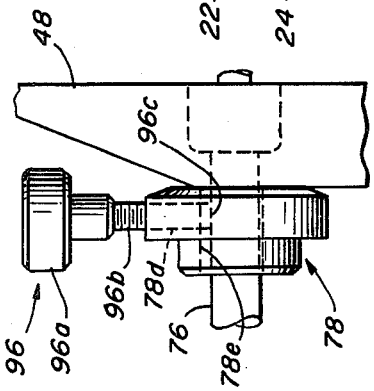
Figure 1C:
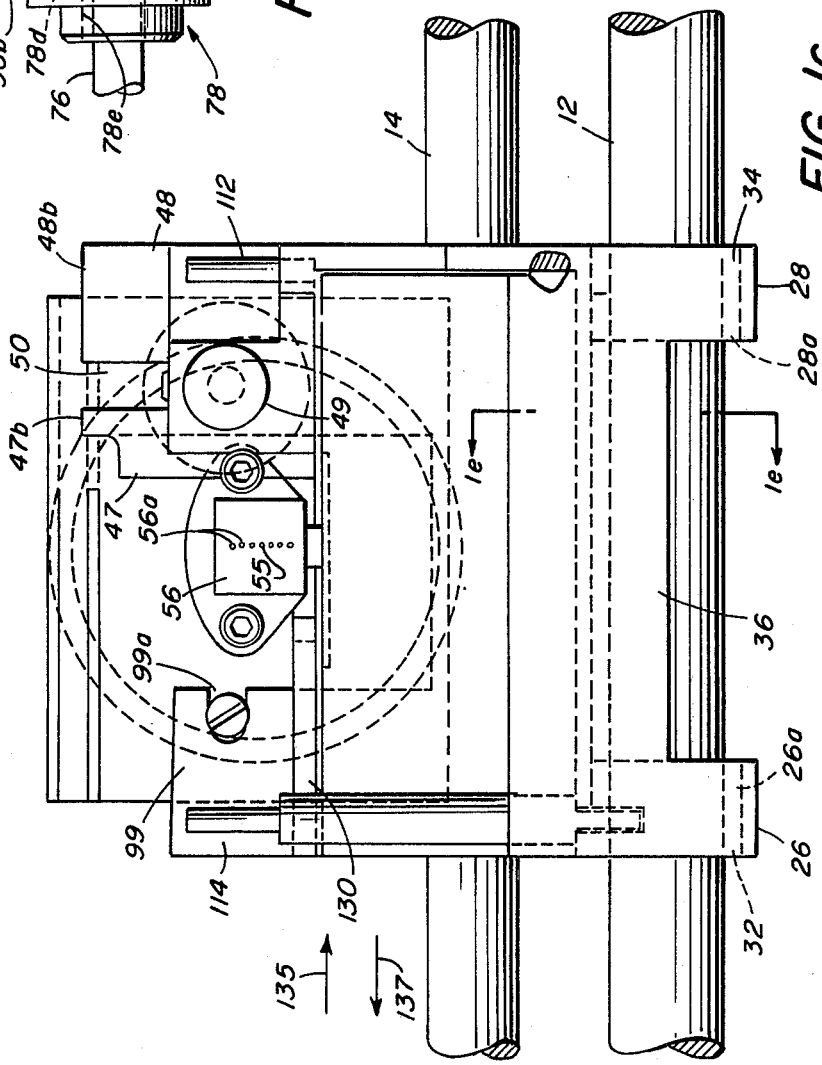
Figure 4C:
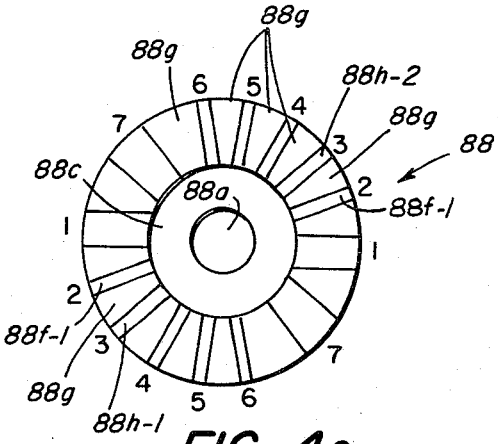
Figure 4B:
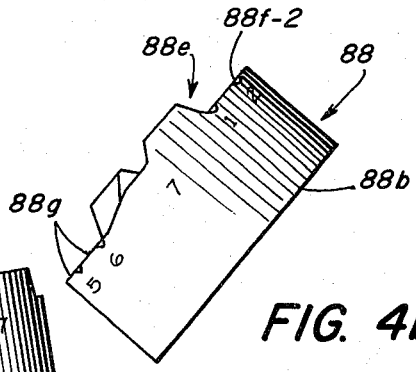
Figure 4A:
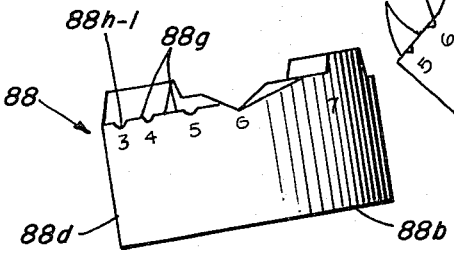

Cam member 88, shown in FIGS. 1*a* and 1*b* and shown in detail in FIGS. 4*a* through 4*c*, is a substantially cylindrical shaped member having a central opening 88*a* for receiving the left-hand end of shaft 76 therethrough. In order to rotatably mount cam member 88 upon shaft 76, Bellville washer 86 is initially mounted within annular groove 76*d*. Thereafter, cam member 88 is mounted on shaft 76 by sliding the left-hand end of shaft 76 through central opening 88 so that the flat surface 88*b* of cam member 88 rests upon an engaging portion of Bellville washer 86. Circular clip 84 is then force-fitted into annular groove 76*c* of shaft 76 so that Bellville washer 86 continuously exerts a biasing force against surface 88*b* of cam 88 maintaining the recessed annular surface 88*c* of cam member 88 which surrounds opening 88*a*, into firm engagement with one surface of circular clip 84, thereby accurately axially positioning the cam member 88 along the longitudinal axis of shaft 76 while enabling cam member 88 to be freely rotated about shaft 76.

Cam 88 is provided with an irregular shaped cam surface 88*e* comprised of a plurality of pairs of radially aligned grooves, each pair of grooves being associated with forms thickness settings numbered "1" through "7" respectively, which designating numerals are arranged about the knurled periphery 88*d* of cam member 88, said knurled periphery 88*d* being provided to facilitate gripping by the fingers of an operator in order to facilitate rotation of the cam member to any desired forms thickness setting. Each pair of grooves is arranged along a common diameter and is adapted to lie in an imaginary plane, such that each pair of recesses lies in a different imaginary plane which imaginary planes lie a predetermined different distance from annular surface 88*c* which slidably engages one surface of clip 84. Pairs of grooves, such as for example, the grooves 88*f*-1 and 88*f*-2, are adapted to seat the apices 72*a* and 74*a* of wing-like projections 72 and 74, shown in FIGS. 3*a* through 3*c*, in order to control the distance of annular surface 88*c* of cam member 88 relative to the apices 72*a* and 74*a*, thereby establishing the displacement between collar 62 and shaft 76, as will be more fully described hereinbelow.

The surface portions 88*g* between grooves such as grooves 88*f*-1, 88*h*-1 and 88*f*-2, 88*h*-2 may be either parallel to surface 88*c* or inclined relative to surface 88*c*, enabling the grooves 88*f*, 88*h* to be of uniform depth, if desired, so long as the pairs of grooves which lie in imaginary planes, are spaced from one another in accordance with the desired forms thicknesses, i.e. so that the imaginary planes are spaced from one another.

As was mentioned hereinabove, the central opening 78*e* in thrust collar 78 slidably receives shaft 76 and is positioned to move between Bellville washer 86 and enlarged diameter portion 76*a*. Opening 78*e* has a significantly larger diameter than the diameter of shaft 76. Thrust member 78 has a substantially cylindrical exterior periphery 78*a* provided with a flange 78*b* at one end thereof. The right-hand edge of flange 78*b* is bevelled at 76*c* to facilitate entry of tapered arms 47, 48 between collar 78 and shaft portion 76*a* to impart slidable movement of thrust member 78 during mounting of the print head 52 and mounting assembly 60 upon the carriage assembly 16, as will be more fully described. Flange 78*b* is provided with a radially aligned tapped opening 78*d*, adapted to receive threaded portion 96*b* of set screw 96 which has an enlarged knurled head 96*a* to facilitate gripping. The bottom 96*c* of threaded portion 96*b* engages shaft 76 and urges the bottom of shaft 76 against the bottom of opening 78*e* when the mounting assembly 60 is in position on carriage 18. Thumb set screw 96 is then tightened to prevent movement of the mounting assembly 60 when the printer is in operation. A helical spring 79, forming part of the mounting assembly 60 encircles the cylindrical shaped periphery 78*a* of thrust member 78 and has its right-hand edge resting against the left-hand edge of flange 78*b*. The left-hand edge of spring 79 bears against the flat surface 88*b* of cam member 88. Helical spring 79 normally urges thrust member 78 toward enlarged diameter portion 76*a* of shaft 76.

As was mentioned hereinabove, collar 62 is provided with a central clearance opening 70 which central opening is adapted to slidably receive the left-hand end 76*e* of shaft 76 to permit axial movement of shaft 76 and to prevent undesirable movement of shaft 76 in a direction transverse to the longitudinal axis of shaft 76, as will be more fully described hereinbelow.

The manner in which the print head assembly 52 and mounting assembly 60 is mounted upon carriage assembly 16 is as follows:

Print head assembly 52 with the mounting assembly 60 secured thereto in a manner described hereinabove, is positioned above the carriage assembly so that the shaft 76 is just above opening 50 between bifurcated arms 47 and 48. Before the print head assembly 52 is mounted upon the carriage assembly 16, set screw 96 is loosened and helical spring 79 urges the right-hand edge of thrust member 78 against the left-hand surface of enlarged diameter portion 76*a* of shaft 76. The mounting assembly 60 is axially aligned relative to arms 47 and 48 so that the upper edges 47*b* and 48*b* of tapered portions 47*a* and 48*a* move between the cured surface 76*a*-1 of shaft 76 and the bevelled surface 78*c* of thrust member 78. In this position, the mounting assembly 60 and print head assembly 52 are pushed downwardly causing the left-hand surface of enlarged diameter portion 76*a* of shaft 76 to move along the vertically aligned right-hand surfaces 47*c*, 48*c* of bifurcated arms 47, 48 and causing the bevelled surface 78*c* of thrust member 78 to be slidably engaged by the sloping surfaces 47*a* and 48*a* of bifurcated arms 47 and 48 whereby thrust member 78 is moved toward the left along shaft 76 relative to FIG. 1*b*, as the print head assembly 52 and mounting assembly 60 are moved downwardly in the direction shown by arrow 93. The mounting assembly is moved downwardly until shaft 76 reaches the base of slot 50 between bifurcated arms 47 and 48, at which time enlarged diameter portion 76*a* of shaft 76 is aligned with enlarged diameter bore 49 provided at the base of slot 50 and whereupon the force of compressed spring 79, which has been compressed due to the slidable movement of thrust member 78 toward cam member 88, causes shaft 76 to be rapidly moved toward the left relative to FIG. 1*b*, causing enlarged diameter portion 76*a* of shaft 76 to snap into enlarged diameter bore 49 and causing stub shaft 82 to enter into slot 99*a* of bracket 99 and causing the free end 76*e* of shaft 76 to enter into the opening 70 in collar 62. At this time, stub shaft 82, which is positioned immediately behind slot 99*a* in carriage bracket 99, is also moved forward to enter into slot 99*a* whereby the entry of enlarged diameter portion 76*a* of shaft 76 into enlarged diameter bore 49 and the entry of pin 82 into slot 99*a* automatically aligns the print head assembly 52 and hence the print wires 55 relative to platen P. Set screw 96 may now be tightened to lock the thrust collar 78 to shaft 76.

The print head 52 and mounting assembly 60 may be removed in a simple and straightforward manner simply by reversing the steps utilized during mounting. More specifically, the print head assembly 52 is removed by gripping the electromagnet supporting assembly 57, which is positioned within the opening 20 defined by carriage assembly sides 18*a*, 18*b* and 18*c*, and moving the print head assembly 52 rearwardly in the direction shown by arrow 103 of FIG. 1*a*, relative to the carriage assembly 16. This rearward movement causes enlarged diameter portion 76*a* of shaft 76 to move out of enlarged bore 49. When the print head assembly 52 is moved a distance sufficient to clear enlarged diameter portion 76*a* from the rear surfaces of bifurcated arms 47 and 48, simultaneously therewith, stub shaft 82 will be cleared of the rear surface of the projection 99 containing slot 99*a*. Also simultaneously therewith, the forward or left-hand end 76*e* of shaft 76 will be cleared of opening 70 in collar 62, enabling print head assembly 52 and mounting assembly 60 to be lifted upwardly in the direction of arrow 95 shown in FIG. 1*b* to simply and rapidly remove the print head assembly 52 and mounting assembly 60 from carriage assembly 16.

The manner in which the forms thickness adjustment is made is as follows:

With the mounting assembly 60 and print head assembly 52 mounted upon carriage assembly 16, screw 44 is loosened. Cam member 60 is rotated so as to align the smallest forms thickness setting (the setting "1") typically employed for single-ply web with the apices 72*a*, 74*a*. A shim 98 is positioned between the front nose 54*a* of the print head assembly nose cone 54 and the forward surface P1 of platen P, shown best in FIG. 1*b*. The print head assembly 52 and mounting assembly 60 is then moved forward so that the left-hand major surface of shim 98 rests against surface P1 of platen P and the right-hand major surface of shim 98 rests against the front surface of the forward end 54*a* of nose cone 54, i.e. against the surface of jewel bearing 56. Holding the print head asssembly 52 in this position, screw 44 is tightened, thereby securing the mounting assembly 60 and hence the print head assembly 52 in the desired position. The thickness of gauge of shim 98 is accurately controlled so as to be precisely equal to or at least nearly equal to and within tight tolerances, the thickness of the single-ply form associated with the present position of the forms thickness cam member 88. Shim 98 is removed by rotating cam member 88 to displace the nose of the print head assembly 52 from platen P to facilitate removal of shim 98 from its position between platen P and nose cone 54. This single adjustment assures that all remaining forms thickness settings are automatically aligned, thereby greatly simplifying the adjustment procedure to a single adjustment operation while precisely aligning all of the forms thickness settings automatically through the single adjustment. Spring 79 causes cam 88 to "snap" into each setting and also serves to retain the cam 88 in the chosen setting. Although the shaft 76 moves slightly, the total range of movement is less than 0.10 inches and the depth of bore 49 and the axial length of enlarged diameter portion 76*a* of shaft 76 are of a length sufficient to maintain the shaft 76 secure upon the carriage 16. Also, the free end 76*e* of shaft 76 is axially slidable within opening 70 in collar 62, opening 70 further serving to prevent "wobbling" of shaft 76, i.e. to prevent movement of shaft 76 transverse to its longitudinal axis.

The carriage assembly, as shown best in FIGS. 1*a* through 1*e* is designed for use in either ribbon type or ribbonless type printers. In order to accommodate ribbon type printers, i.e. printers utilized an inked ribbon, carriage assembly 16 is provided with a pair of upright, cylindrical shaped projections 12 and 114, shown in FIGS. 1*b* and 1*c* and adapted to receive freewheelingly mounted roller members (not shown) for guiding an inked ribbon (not shown) across the front face of jewel bearing 56, as is conventional.

A latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for adjustably positioning a printing means on a carriage relative to a print receiving medium comprising:

a carriage;

cam means rotatably mounted on said printing means by means of a cam support member;

cam engaging means mounted on said carriage and having a projection extending toward said cam means;

said cam means having a cam surface provided with a plurality of grooves adapted to receive said projection, said grooves lying in imaginary planes which planes are spaced from one another;

a means on said carriage for slidably receiving a portion of said cam support member;

bias means normally urging said cam surface toward said projection and normally urging said cam support member toward said means for receiving said cam support member.

2. The apparatus of claim 1 further comprising a support on said carriage having an opening;

said cam engaging means being arranged in said opening and being axially adjustable therealong;

means on said support for securing said cam engaging means at the adjusted position, whereby all cam settings are adjusted through adjustment of said cam engaging means.

3. The apparatus of claim 1 wherein said cam support member has a free end extending beyond said cam means; and said cam engaging means is provided with an opening for receiving the free end of said cam support member which is slidable within said opening and which opening serves to stabilize the free end of the cam support member against any movement transverse to the axis of rotation of said cam means.

4. The apparatus of claim 1 wherein each of said grooves comprise a pair of grooves arranged along a diameter of said cam means and spaced at angular intervals from the other pairs of grooves;

said projection comprising a pair of wing-like members extending outwardly on opposite sides from a main body portion and having tapered edges directed towards said cam means and adapted to be seated in any one of said pair of grooves.

5. The apparatus of claim 4 wherein said grooves are of different depths.

6. The apparatus of claim 4 wherein said grooves are of uniform depth.

7. The apparatus of claim 6 wherein the surfaces between adjacent grooves are diagonally aligned relative to the axis of rotation of said cam means.

8. Means for releasably mounting printing means upon a movable carriage, said carriage comprising means for receiving said printing means;

said releasable mounting means being secured to said printing means and having a mounting portion;

said means for receiving said printing means comprising:

means defining an elongated slot extending inwardly from one edge of said means for receiving said printing means, and a supporting portion arranged along said slot and inwardly from said one edge for receiving said mounting portion, said mounting means comprising an elongated rod slidable within said slot, said mounting portion comprising an enlarged diameter portion along said rod which is incapable of entering said slot and is adapted to fit into said supporting portion, said supporting portion comprising a bore of a diameter greater than the width of said slot and adapted to receive said enlarged diameter portion along said rod, and slidable means comprising a sleeve slidable along said rod and biased toward said enlarged diameter portion to retain said enlarged diameter portion in said bore, said sleeve having a radially aligned tapped opening and locking means for selectively locking said sleeve to said rod, comprising a threaded member threaded into said opening to engage said rod for locking said sleeve to said rod.

* * * * *